United States Patent [19]

Bessinger et al.

[11] Patent Number: 4,981,327

[45] Date of Patent: Jan. 1, 1991

[54] METHOD AND APPARATUS FOR SENSING COAL-ROCK INTERFACE

[75] Inventors: Stephen L. Bessinger, Morgantown, W. Va.; Michael G. Nelson, Bethel Park, Pa.

[73] Assignee: Consolidation Coal Company, Pittsburgh, Pa.

[21] Appl. No.: 364,042

[22] Filed: Jun. 9, 1989

[51] Int. Cl.[5] ..... E21C 35/08

[52] U.S. Cl. ..... 299/1; 299/45

[58] Field of Search ..... 299/1, 42, 43, 45, 67

[56] References Cited

U.S. PATENT DOCUMENTS

| | | | |
|---|---|---|---|
| 3,591,235 | 7/1971 | Addison | 299/1 |
| 3,719,394 | 3/1973 | Hartley | 299/1 |
| 4,072,349 | 2/1978 | Hartley | 299/1 |
| 4,155,594 | 5/1979 | Hartley et al. | 299/1 |
| 4,262,964 | 4/1981 | Ingle et al. | 299/1 |
| 4,643,482 | 2/1987 | Wolfenden | 299/1 |

FOREIGN PATENT DOCUMENTS

| | | | |
|---|---|---|---|
| 1203362 | 8/1970 | United Kingdom | 299/1 |
| 2092641 | 8/1982 | United Kingdom | 299/1 |

*Primary Examiner*—Ramon S. Britts
*Assistant Examiner*—David J. Bagnell
*Attorney, Agent, or Firm*—Alan McCartney

[57] ABSTRACT

The method and apparatus for sensing the coal-rock interface while longwall mining by placing the sensor in the cowl adjacent the shearer drum so that sensor on the leading drum can feedforward interface data for the control of the trailing shearer drum by properly positioning the drum while cutting.

3 Claims, 4 Drawing Sheets

METHOD AND APPARATUS FOR SENSING COAL-ROCK INTERFACE

BACKGROUND OF THE INVENTION

Field of the Invention

This invention relates to the placing of boundary coal thickness sensors on the cowls of the longwall shearer so that the sensor on the cowl of the leading shearer drum will measure coal thickness in advance of the trailing drum, allowing control of the cutting horizon of the trailing shearer drum in a feedforward mode.

SUMMARY OF THE PRIOR ART

There have been many different approaches to controlling the cutting horizon of longwall shearer drums to maintain the proper roof and floor coal thickness to maximize coal recovery and maintain roof stability. For example, U.S. Pat. No. 4,228,508 describes a control scheme using coal seam boundary data which has been measured and averaged for several passes, then used as inputs to a program which modifies a pre-established interface-shaped program. U.S. Pat. No. 4,155,594 teaches using an ultrasonic instrument which reads coal thickness on previous and current passes U.S. Pat. No. 4,634,186 discloses adjusting the cutting horizon as a function of miner body inclination. U.S. Pat. No. 4,643,482 discloses steering the miner along the longwall face by using a series of spaced referenced locations to sense the cutting horizon of each drum at each reference location and applying steering corrections as necessary.

SUMMARY OF THE INVENTION

It is the purpose of this invention to place coal thickness sensors on the cowls of a longwall shearer so that the sensor on the leading drum can provide a measurement of the coal thickness left for feedforward control of the trailing shearer cutting horizon.

It is a further object of this invention to provide a cowl mounted sensor of the coal-rock interface which in one position of the cowl can survey the floor and in another position survey the roof to input the control of the cutting horizon of both shearers of a longwall miner.

DESCRIPTION OF THE PREFERRED EMBODIMENT

Concepts for controlling the cutting horizon of a longwall shearing machine almost always involve the use of a coal-rock interface detector for feedback to the control algorithm.

When operating constrain&s require that a coal layer be left on the roof or the floor, the usual practice is to use a natural gamma background sensor to measure the thickness of the coal layer after it is cut. Such schemes have been used, or proposed, with a single sensor mounted on the shearer or on an auxiliary arm alongside the ranging arm, or with several sensors mounted in selected shield canopies, alongside selected shield toes, or periodically under the cable tray. Data from such instruments are usually collected for an entire shearer cycle, to allow for smoothing, filtering, and trend analysis, then used for horizon control in the next shearing cycle. When the instrument "looks" at the roof or floor just a few feet behind the freshly cut surface, direct feedback of the instrument reading to the horizon control loop results in a classic case of resonant instability.

When operating practice dictates removal of all the coal, the cut cannot be controlled using data from a gamma background sensor, because such a sensor must measure a finite thickness of coal. A wide variety of methods have tested for detection of the coal/rock interface. Optical methods have been unsuccessful even in the laboratory; methods which sense cutting tool vibration or total machine vibration have worked in the laboratory, but not in actual operation.

A new and novel method for the use of a coal thickness sensor in horizon control is a feedforward system. Measurement in feedforward mode anticipates what has to be done, whereas the measurement in the feedback mode senses what has been done and adjusts accordingly. This method would use a coal thickness sensor mounted near the cutting drums, on the cowls, to measure the thickness of the benches left by the leading drum. These thickness measurements would then be used as feedforward inputs to the control loop for the trailing drum, which would cut the remaining benches. Feedforward control is inherently stable, and its use in this application would allow for much better control of the cutting horizon. Further, the use of feedforward control in this manner will allow the use of gamma background sensors for control of the cut even when no coal is left on the roof or floor.

As is shown in FIGS. 1 and 2, this method can be used for control of the drum which cuts the floor in typical cutting patterns of either the bi-directional, full-face type or the uni-directional, half-face type or for feedforward control of both roof and floors cuts in standard half-face cutting, as shown in FIG. 3. These figures do not show all the possible applications of feedforward control to longwall mining, only those which are most typical.

Figure 1A:
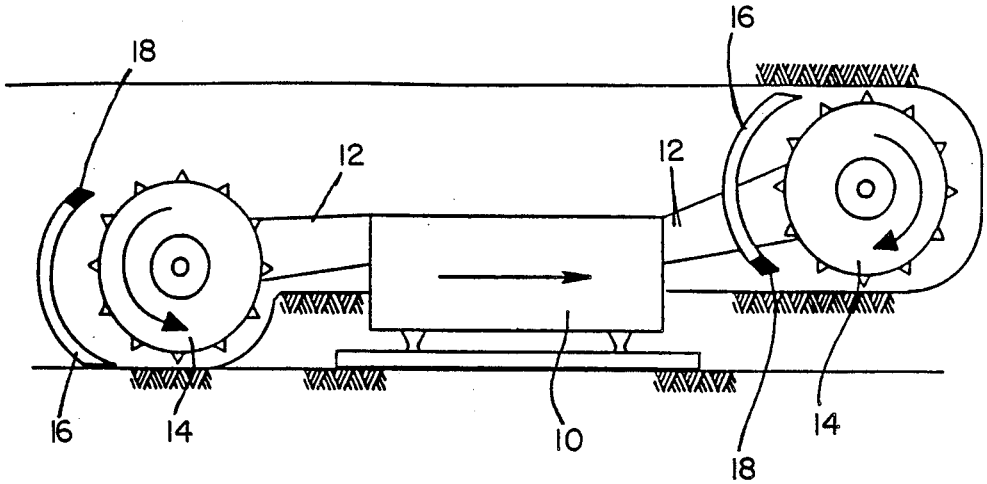
FIGS. 1*a* and 1*b* are diagrammatic illustrations of a longwall shearer having cowl mounted sensors for feedforward control of the floor cut during full-face cutting.
Figure 1B:
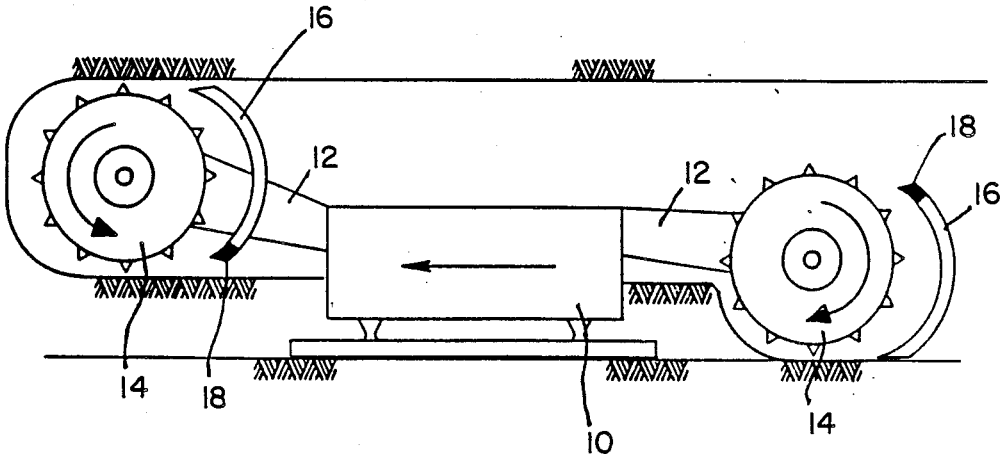

In FIGS. 1*a* and 1*b* the shearer 10 has shearer ranging arms 12 carrying cutting drums 14. Cowls 16 are supported to load the coal cut from the face onto a conveyor in a well-known manner. Mounted on each cowl are sensors 18 of the coal-rock interface.

As the miner in FIG. 1*a* takes a full-face cut to the right, the leading drum 14 cuts under feedback control using data from the sensor on the opposite cowl. These data may be those stored from the last cut, or those measured in real time, depending on the stability requirements of the system. The cowl mounted sensor with the leading drum will survey the floor bench for feedforward control of the trailing drum. This sensor will input to the control of the trailing drum position to remove the predesired amount of coal. Also, the cowl-mounted sensor on the trailing drum will measure the coal thickness of the roof for a feedback to the control of the cut of the roof by the right-hand drum on the return pass. It can thus be seen that in FIG. 1*a*, the leading drum feeds the floor interface data forward to the trailing drum control by anticipating the interface location whereas the trailing drum cowl sensor feeds back the interface location for control of the upper drum in the return pass, in FIG. 1*b*.

On the return, full face cut (FIG. 1*b*) the lead drum cuts the roof under feedback control, and the lead drum cowl-mounted sensor feeds forward the coal-rock interface data to the trailing drum control to set the drum cutting height for cutting the floor. At the same time, the trailing drum cowl mounted sensor surveys the roof to input the control of the upper drum.

Figure 2A:
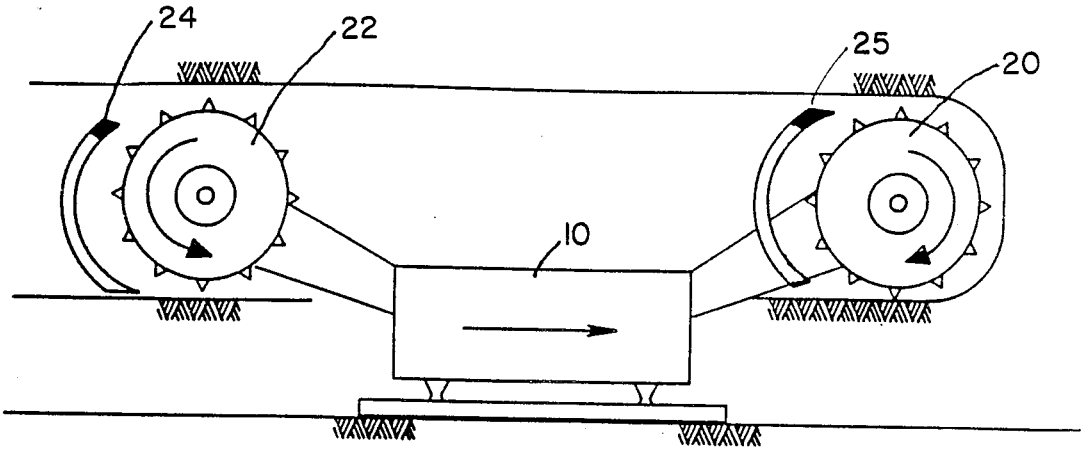
FIGS. 2*a* and 2*b* are diagrammatic illustrations of the feedforward control of the floor cut during modified half-face cutting.
Figure 2B:
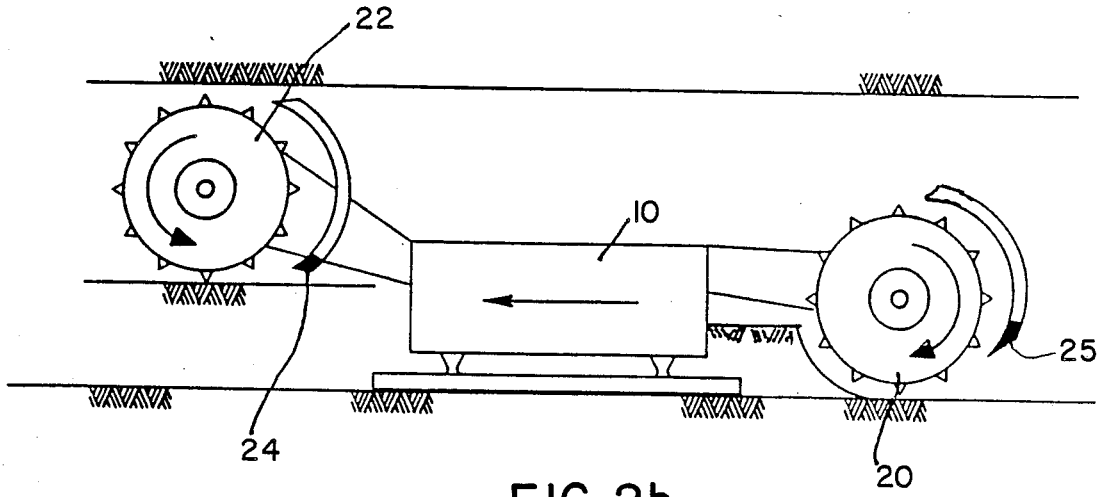

Attention is now directed to FIGS. 2*a* and 2*b*, which illustrate the use of the cowl-mounted sensors for feedforward control of the floor cut in modified, half-face cutting. As the miner makes a half-face cut to the right, the lead drum 20 cuts the roof or near the roof and the trailing drum 22 idles and cleans up. The cowl mounted sensor 24 measures the roof thickness for feedback to control the next pass. On the return pass (FIG. 2*b*) the lead drum 22 idles and the cowl mounted sensor 24 measures the coal thickness for feedforward control of the trailing drum 20 which cuts the floor. It should be noted that this cutting sequence could be further modified for feedforward control of the roof cut by mounting a sensor 25 on the upper portion of the right cowl and then during the first half cut (FIG. 2*a*) leaving a small amount of roof coal (in addition to the floor bench) and trimming the roof with the trailing drum, using a feedforward control input from the sensor on the leading cowl. This mounting arrangement for the sensor has been illustrated din FIGS. 4*a* and 4*b*.

Figure 3A:
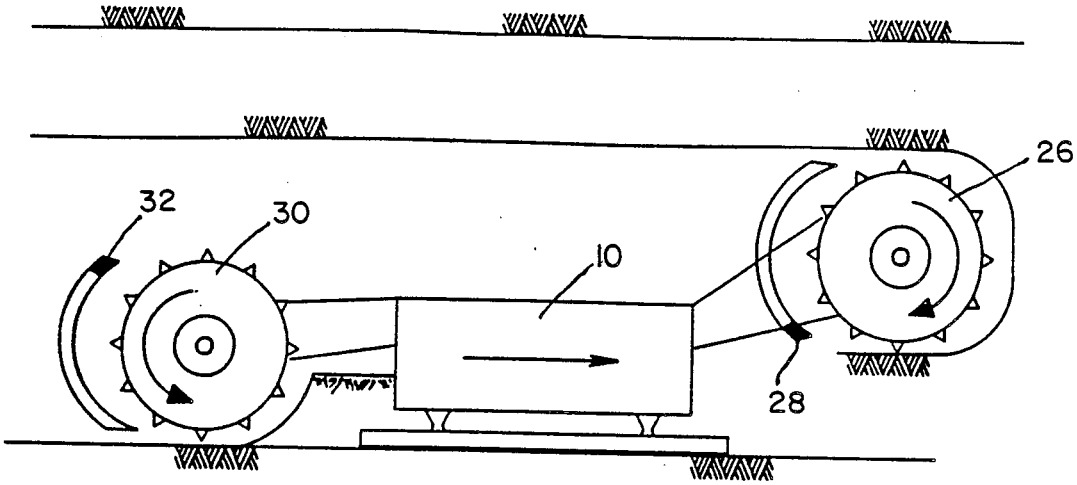
FIGS. 3*a* and 3*b* are diagrammatic illustrations of the feedforward control of both the roof and floor cut during standard half-face cutting; and, FIGS. 4*a* and 4*b* are illustrations of a cowl mounted sensor that can survey both roof and floor during half-face cutting.
Figure 3B:
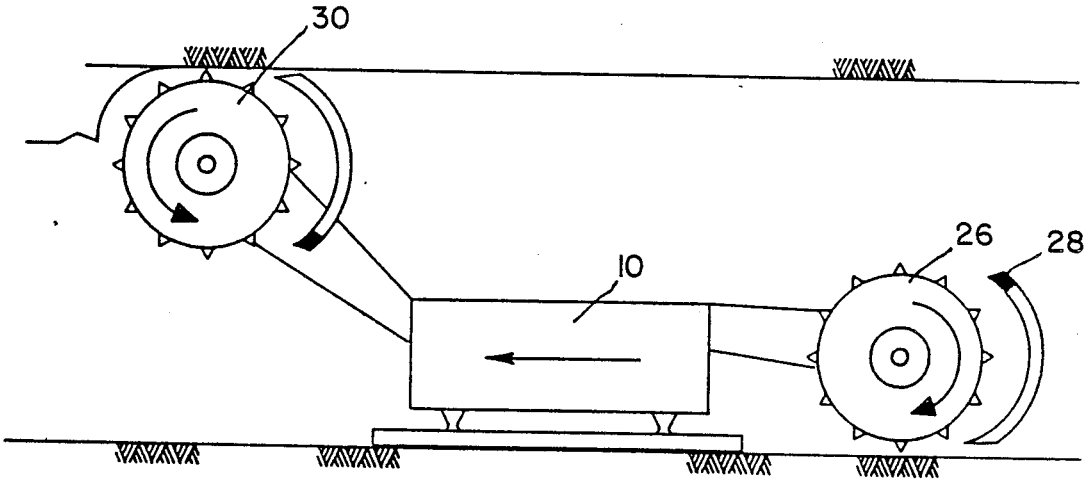

FIGS. 3*a* and 3*b* illustrate the use of the cowl-mounted sensors for feedforward control of the entire standard half-face method. In the pass to the right, the lead drum 26 cuts the middle of the seam leaving coal on the roof and floor. The lead cowl-mounted sensor 28 measures the floor bench for feedforward input to the control of the trailing drum 30 which cuts the floor. At the same time, the trailing cowl mounted sensor 32 measures the roof thickness for feedforward control of the roof cut in the second half of the pass (FIG. 3*b*). In the second half of the standard half-face pass (FIG. 3*b*), the leading drum 30 cuts the roof under the control of the data from the first half cut (sensor 32) and trailing drum idles and cleans up.

Figure 4A:
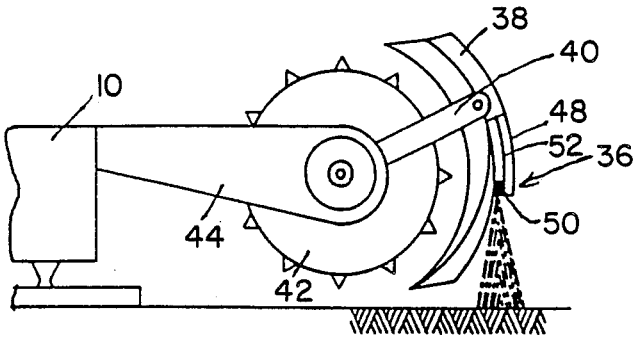
Figure 4B:
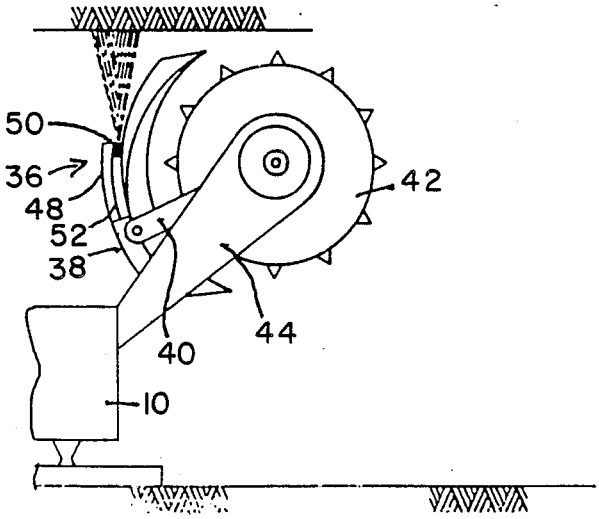

Attention is now directed to FIGS. 4*a* and 4*b* which illustrate a cowl mounted sensor 36 which can look at the floor if one pass (FIG. 4*a*) and the roof in the other pass (FIG. 4*b*). The cowl 38 carried on cowl turning arm 40 is adjacent to the drum 42 on shearer ranging arm 44, and can be rotated through conventional linkage to guide material while the drum cuts either the floor or the roof. The rearward portion 46 of cowl 38 has a housing area 48 carrying the sensor 50 and electronics/power supply/communication compartment 52. The sensor is recessed in housing 48 for protection from debris and has a scanning area as illustrated. Thus, it can be seen that by using a single sensor and a modified half-face mining method (FIGS. 2*a* and 2*b*) both the roof and floor interfaces can be surveyed by a single sensor.

In the feedforward mode, the leading sensor senses the floor interface before the trailing drum cut whereas in the feedback mode, the trailing sensor senses the roof interface after it has been cut, for input to control of the leading drum in the return direction.

We claim:

1. A method of controlling the operating position of the leading and trailing shearer drums of a longwall shearer, the drums being carried on ranging arms which also support leading and trailing cowls each having a housing supporting coal-rock interface sensors spaced from the roof and floor coal surface comprising:

a. positioning the leading shearer drum cowl for permitting the coal-rock interface sensor to look downwardly to the floor to collect data on the coal-rock interface left below the leading shearer drums after the passing of the leading shearer drum, and;

b. feedforwarding the collected data to the control of the trailing shearer drum to anticipate proper positioning of the trailing shearer drum at the floor coal-rock interface.

2. In a longwall shearer having leading and trailing shearer drums passing across a mine panel having a roof and a floor with each shearer drum being carried on a ranging arm positioned in response to a controller comprising:

a. leading and trailing cows carried on the respective ranging arm adjacent to the shearer drum and adapted to guide material;

b. each of said cowls having a housing partially enclosing a coal-rock interface sensor to provide the controller with interface data; and, c. the sensor of the leading cowl looking downwardly inputting the controller to the trailing shearer drum to feedforward the floor coal-rock interface data below the leading shearer drum to the controller to position the trailing shearer drum.

3. The longwall shearer of claim 2 wherein said cowl housing includes a power supply for the sensor.

* * * * *